United States Patent [19]

Lindsey et al.

[11] Patent Number: 4,880,058

[45] Date of Patent: Nov. 14, 1989

[54] STAGE CEMENTING VALVE

[75] Inventors: Hiram E. Lindsey, Midland; Richard W. Adams, Bryan, both of Tex.

[73] Assignee: Lindsey Completion Systems, Inc., Midland, Tex.

[21] Appl. No.: 194,132

[22] Filed: May 16, 1988

[51] Int. Cl.[4] ..... E21B 33/16; E21B 34/14

[52] U.S. Cl. ..... 166/289; 166/154; 166/237; 166/291; 166/323

[58] Field of Search ..... 166/289, 291, 285, 373, 166/374, 153, 154, 156, 237, 317, 318, 321, 323, 332

[56] References Cited

U.S. PATENT DOCUMENTS

| | | | |
|---|---|---|---|
| 2,855,952 | 10/1958 | Tausch et al. | 166/332 X |
| 2,947,363 | 8/1960 | Sackett et al. | 166/154 X |
| 3,970,147 | 7/1976 | Jessup et al. | 166/323 X |
| 4,113,012 | 9/1978 | Evans et al. | 166/264 |
| 4,403,659 | 9/1983 | Upchurch | 166/321 X |
| 4,576,233 | 3/1986 | George | 166/373 X |
| 4,603,741 | 8/1986 | Edgmon | 166/317 X |
| 4,671,358 | 6/1987 | Lindsey, Jr. et al. | 166/291 |

FOREIGN PATENT DOCUMENTS

| | | | |
|---|---|---|---|
| 702157 | 12/1979 | U.S.S.R. | 166/318 |
| 926240 | 5/1982 | U.S.S.R. | 166/285 |

*Primary Examiner*—Hoang C. Dang

[57] ABSTRACT

A stage valve for stage cementing of casings in a well bore including a tubular collar and a telescopic tubular sleeve where the sleeve has a piston portion disposed in a collar chamber and the piston portion separates a sleeve port from a collar port in a lower position. In the lower position, the sleeve mechanically engages the collar and is movable to an upper position by a differential hydraulic pressure across the piston portion to an upper position placing the sleeve port and the collar port in fluid communication with one another. In moving to the upper position, the sleeve removes a barrier from a ratchet ring in the collar so that when the sleeve is moved downwardly from an upper position, a ratchet portion on the sleeve engages the ratchet ring in a lower position of the sleeve to lock the sleeve in a closed position.

15 Claims, 2 Drawing Sheets

STAGE CEMENTING VALVE

FIELD OF THE INVENTION

This invention relates to methods and apparatus for stage cementing of a string of tubular pipe in a well bore, and more particularly, to a pressure operated, single sleeve, stage valve system for use in cementing a string of pipe in a well bore.

BACKGROUND OF THE PRESENT INVENTION

A well for producing hydrocarbon from subterranean earth formations is lined with tubular steel pipe and the annulus between the pipe and the well bore is filled during a completion process with a liquid cement slurry which sets and then supports the pipe in the well bore as well as filling the annulus between the pipe and the well bore. Sometimes the well, because of its depth or the formations encountered, is drilled in successive sections or lengths which have even decreasing well bore diameters. Sometimes the surface "casing" pipe is set and cemented in place in a drilled section of a well before drilling deeper. Where there is a casing pipe string cemented in place, the subsequent degree sections of the well are lined with a tubular pipe called a "liner" because the top of a liner is located in a well below the ground level. Sometimes, a string of pipe extends from a lower section of the well to the ground surface and also through a casing.

In any event, this invention is directed to a system which employs stage collars, i.e. a selectively operable valve located intermediate the length of a string of pipe. A stage valve is typically used in a cementing operation where the length of the annulus to be cemented requires a volume of cement slurry which would adversely affect the earth formations or pipe because of the pressure developed by the volume of cement slurry in a pipe or in the annulus between a pipe and a well bore. Thus, the cementing of a long length of pipe in one continuous string of pipe is accomplished by inserting a stage valve intermediate the length of the string of pipe so that a first discrete volume of cement slurry can be used to fill the annulus between the bottom of the well bore and the stage collar. While the cement slurry sets up in the lower section of pipe below the stage collar, the stage collar is opened so that mud can be circulated through the pipe, the stage valve and return to the surface via the annulus between the pipe above the stage collar and the well bore. Next, a second volume of cement slurry is injected through the pipe, the stage collar and into the upper annulus between the well bore and the pipe. When the desired amount of cement slurry has been injected into the upper annulus about the pipe, the stage collar is closed and the cement slurry sets up in the upper annulus.

The stage collar systems used to date are two in number. In the first system, the stage collar has independent, upper and lower longitudinally movable sleeve members and is normally in a closed position with ports closed by the lower sleeve member. The lower annulus below the stage valve is first cemented. Then, by dropping a closure member such as a ball, wiper plug or cementing dart at the trailing end of the flow of cement slurry for the lower annulus, the closure member will subsequently engage the lower sleeve member and close off the lower sleeve member in the stage valve. When closed off, the lower sleeve member is then moved longitudinally to an open position by hydraulic pressure generating a force acting on the closure member seated in the lower sleeve member. When the lower sleeve member is moved to an open position, fluid communication is established between the interior or bore of the pipe and the annulus between the pipe and the well bore. When the stage valve is in the open position, a second cement slurry can be introduced through the stage valve to the upper annulus between the pipe and the well bore above the stage valve. A cementing wiper plug follows the trailing end of the second cement slurry and follows the flow of cement slurry in the pipe until the plug engages and moves the upper sleeve member in the stage valve to a closed position where the opening in the stage valve to the annulus is blocked so as to retain a back pressure on the cement slurry in the annulus. Thus, the typical stage valve utilizes two independently movable sleeve members and is opened and closed by two separate closure members. In this process, the bore of the lower part of the pipe below the stage collar is not wiped free of cement and the lower zone cement may even be contaminated due to co-mingling of the cement with the buffer fluid.

In the second system, after the lower annulus is cemented, a tool with a device for operating an opening sleeve and a closing sleeve is lowered on tubing or drill pipe to first shift a sleeve valve to an open position with the opening sleeve and then shift the tubing to mechanically close the sleeve valve with the closing sleeve.

In a cementing operation, where a wiper plug follows the cementing slurry, the wiper plug has elastomer cups for wiping the bore of the pipe and the wiper plug ultimately latches into a receiving location in the string of pipe. One of the problems with the stage valve cementing system is that if a wiper plug is passed through a mechanically operated stage collar there is a change that the wiper plug will prematurely actuate the stage collar and cause a loss of pressure on the cement slurry below the stage collar. If a wiper plug is not used, then cement slurry is not cleanly removed from the lower section of pipe below a stage valve.

THE PRESENT INVENTION

In the present invention, the stage valve system intermediate to the length of a pipe uses a single longitudinally movable sleeve member and does not require engagement with a ball or plug closure member to move the sleeve member and to open the stage valve. Additionally, the stage valve cannot be accidentally opened by wiper plugs or closure members. The stage valve includes a piston portion located on a longitudinally movable, tubular valve sleeve where the valve sleeve is slidably and sealingly received in an annular recess in a tubular stage collar. An area or upper chamber above the piston portion has a port in fluid communication with the annulus between the stage collar and the well bore and an area or lower chamber below the piston portion has a port in fluid communication with the interior or bore of the valve sleeve. In an initial operating position, the piston portion separates and prevents fluid communication between the port in the stage collar and the port in the valve sleeve. A shear pin prevents any upward movement of the valve sleeve, while contacting shoulders prevent downward travel. Below the piston portion and the lower chamber, the valve sleeve has an annular external ratchet portion and below the external ratchet portion is an annular groove or recess. In the stage collar, in the initial operating position of the sleeve valve, an annular, resilient, internal ratchet ring member is separated from the external ratchet portion on the valve sleeve by a thin collapsible or contractable sleeve member where the wall thickness of the collapsible sleeve member is less than the depth of the annular groove in the valve sleeve.

By introducing a hydraulic pressure in the bore of the valve sleeve to one surface of the piston portion and with the hydraulic pressure in the annulus exterior to the stage collar applied to the other surface of the piston portion, a differential pressure can develop sufficient to move the piston portion upwardly to place the respective ports in the collar and the sleeve valve in fluid communication with one another. Also, when the valve sleeve is moved upwardly, the exterior ratchet portion on the sleeve valve is displaced from beneath the resilient thin sleeve member and the annular groove is positioned adjacent to the thin sleeve member. In this position the resilient sleeve member moves or contracts into the annular groove on the valve sleeve thereby releasing the internal ratchet ring member so that it can resiliently contract. Cement slurry can then be passed from the bore of the valve sleeve through the ports to the annulus between the pipe and the borehole.

In the trailing end of a cement slurry is a wiper plug which is received in an annular seat in the valve sleeve so that hydraulic pressure in the pipe above the wiper plug can be applied to displace the valve sleeve from an upper position to its initial position thereby moving the contracted sleeve member in the annular groove from underneath the resilient internal ratchet ring member and moving the external ratchet portion on the valve sleeve into ratcheting engagement with the internal ratchet ring member in the stage collar. When the internal ratchet ring member engages the external ratchet portion on the valve sleeve, the stage valve is locked in the initial closed position and holds back pressure on the cement in the annulus.

DESCRIPTION OF THE PRESENT INVENTION

Figure 1:
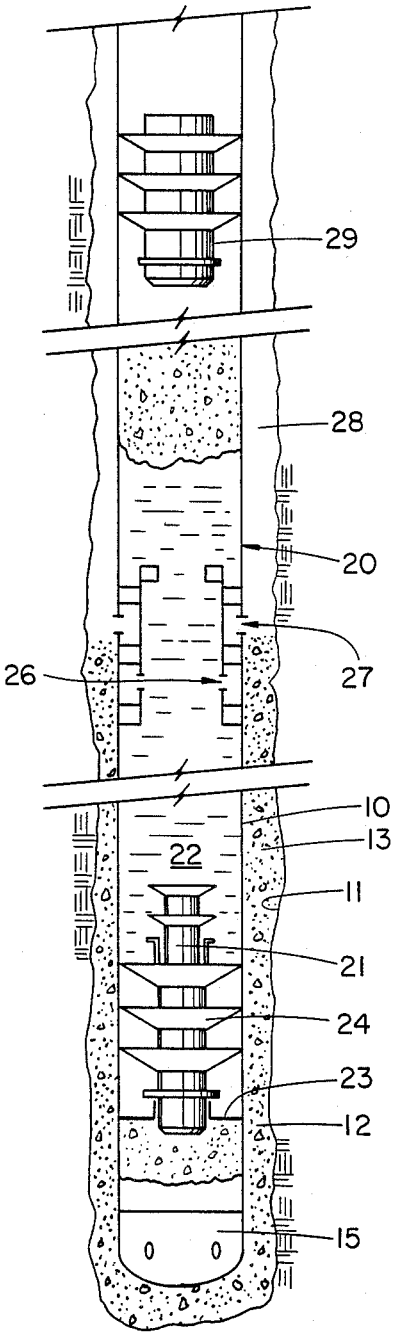
FIG. 1 is a schematic illustration of a stage cementing operation.

Referring now to FIG. 1, a tubular steel casing or pipe 10 is shown disposed in a well bore 11 with the annulus 12 between the casing and well bore having a cement sheath 13 which supports the casing in the well bore 11. At the lower end of the pipe 10 is a cementing shoe and back pressure valve or valves 15 (sometimes called cementing float equipment). Intermediate of the length of the pipe 10 is a hydraulically operated stage cementing collar or stage valve 20. The cementing shoe and back pressure valves 15 at the lower end of the pipe 10 permit displacement of a cement slurry from the lower end of the pipe 10 into the annulus 12 between the pipe 10 and the borehole 11. The stage cementing collar 20 is ordinarily closed while the lower annular segment about the pipe 10 is cemented by flowing cement slurry though the pipe 10 and the shoe 15.

In operation, a first calculated volume of cement slurry is pumped through the pipe 10, the stage cementing collar 20 and through the cementing equipment 15 at the lower end of the pipe 10. The volume of cement slurry is displaced in the annulus 12 between the pipe 10 and the well bore 11 usually to a level slightly above or below the stage cementing collar 20 with the trailing end of the volume of cement slurry being located at the cementing equipment 15 at the lower end of the liner. Following the trailing end of the cement slurry is a wiper plug 21 and column of mud 22 in the pipe 10. The wiper plug 21 passes through the hydraulically operated stage collar 20 to the lower end of the pipe where it sealingly engages a plug catcher 23 above the lower end of the pipe. The cups 24 on the wiper plug wipe the bore of the pipe 10 below the stage collar 20. When the wiper plug 21 latches in the plug catcher 23, the cement slurry is in the annulus between the bottom of the well bore 11 and the stage collar 20. Next the pressure on the mud is increased in the pipe. The pressure buildup in the pipe operates the valve stage collar 20 to move a sleeve upwardly and to place ports 26, 27 in the stage collar 25 in fluid communication with one another.

With the stage valve 20 in an open position, the mud can be circulated to the earth's surface via the stage valve and the annulus 28 above the stage collar while the cement sets up below the stage collar.

Next, a second volume of cement slurry is introduced to the pipe 10 and to the upper annulus 28 between the stage valve 20 and the pipe 10. At the trailing end of the second slurry of cement, a wiper plug 29 moves through the pipe 10 until it seats and locks into the stage collar 20. The wiper plug 29, under pressure, then moves the sleeve in the stage collar downwardly to a closed position as shown in FIG. 1.

Figure 2:
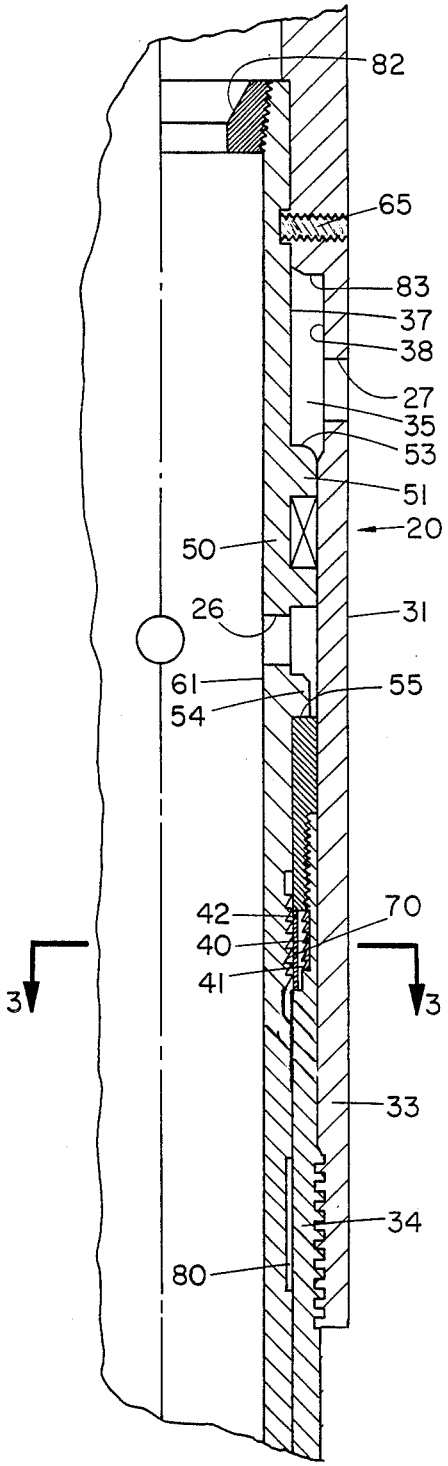
FIG. 2 is an illustration in partial longitudinal view of a stage cementing sleeve valve embodying the principals of the present invention.
Figure 3:
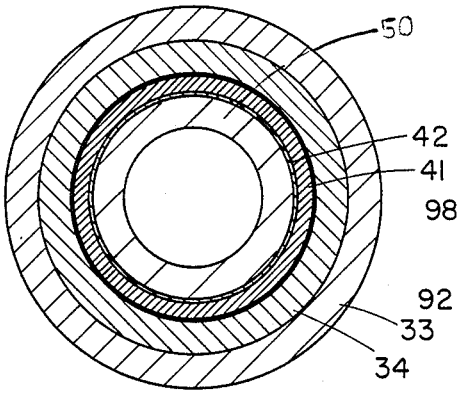
FIG. 3 is an illustration in cross-section taken along line 3—3 of FIG. 2.
Figure 4:
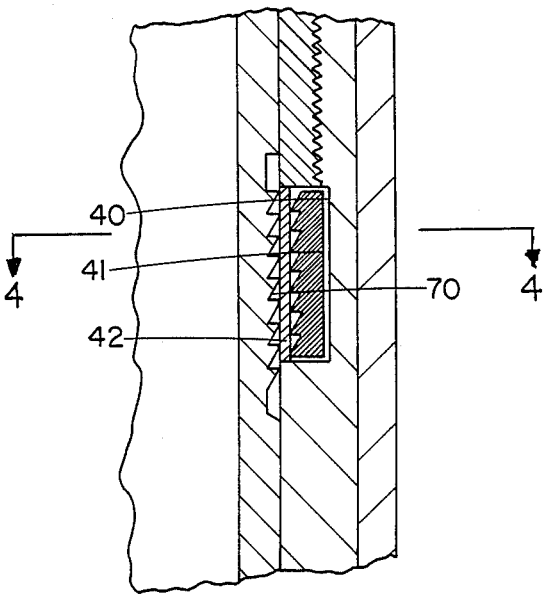
FIG. 4 is an illustration in cross-section taken along line 4—4 of FIG. 3.

Referring now to FIG. 2, a stage valve or stage collar 20 is shown in partial longitudinal cross-section and illustrates the present invention. The stage valve has a tubular stage collar housing member 31, the housing member 31 being adapted for coupling in a string of pipe at an intermediate location along the length of the pipe. The housing member 31 includes threadedly interconnected tubular part members 33, 34 which define an internal annular recess 35 between inner and outer wall surfaces 37, 38. Below the annular recess 35, the housing member 31 has a lower annular locking recess 40 which contains an internally serrated, resilient ring member 41 and an annular, inner collapsible sleeve member 42 disposed in the inner circumference of the serrated section of the annular ring member 41. A tubular sleeve valve member 50 is telescopically and slidably received in the housing member 31. The sleeve valve member 50 has a piston portion 51 with a sealing member where the piston portion 51 is slidable in the annular recess 35 and where the piston portion 51 also defines an upper flange 53. Spaced downwardly from the piston portion 51 is a lower flange 54 for engaging an upwardly facing surface 55 on the housing member 31 when the piston portion 51 is in an initial position in the annular recess 35. Between the piston portion 51 and the lower flange 54 is a port 26 which places the interior 61 of the sleeve valve member 50 in fluid communication with the portion of the annular recess below the piston portion 51. The housing member 31 has a port 27 located above the piston portion 51 when the sleeve valve member 50 is in an initial position. A shear pin 65 interconnects the housing member 31 and the sleeve valve member 50 to retain the piston portion 51 in the position shown in the drawing. From the description and illustrations it can be seen that the ports 26, 27 can not be placed in fluid communication with one another by a downward movement of the sleeve member 50. This permits passage of wiper plugs without actuating the sleeve member 50.

Below the lower flange 54 on the valve sleeve member 50 is an annular serrated section 70 which, in the position shown, is disposed underneath the thin wall, resilient sleeve member 42. The annular serrated section 70 is prevented from engaging the serrated annular resilient ring member 41 by the thin sleeve member 42. Below the serrated section 70 on the valve sleeve member 50 is an annular recess or groove 80 sized to receive the thin sleeve member 42 in an upper position of the valve sleeve member 50. At the upper end of the valve sleeve member 50 is an annular tapered seat member 82 for receiving a ball or sealing plug member.

In operation, the stage collar 20 is located along the length of a string of pipe and inserted into a well bore. At the lower end of the pipe is float equipment 15 and a wiper plug catcher 23. A first volume of cement slurry is introduced into the pipe string and is followed by a wiper plug 21. The first volume of cement slurry is calculated to fill the lower annulus below and to the stage collar 20 when the wiper plug 21 latches into the plug catcher 23. The wiper plug 21 does not and cannot activate the stage collar 20 because the shoulder 55 is engaged by the flange 54 in the downward and closed position of the sleeve member 50. When the plug 21 is latched into the catcher 23, a pressure buildup in the string of pipe ultimately causes the shear pin 65 to shear and the sleeve member 51 to move upwardly to an open position and placing the ports 26, 27 in fluid communication with one another so that the upper annulus above the stage collar 20 can be circulated. When the sleeve member 51 moves to the open position, the recess 80 receives the annular resilient member 42. Next a second calculated volume of cement slurry is introduced to the upper annulus through the stage collar 20 and is followed by a wiper plug. The wiper plug ultimately engages and locks into the seat 82 so that additional pressure moves the sleeve member 51 downwardly to bring the flange 54 into engagement with the shoulder 55. The sleeve member 51 carries the resilient member 42 in the recess 80 past the resilient latching ring 41 so that the latching portion 70 on the sleeve member 51 interengages with the ring 41 and locks the sleeve member 51 in the closed position.

Figure 5:
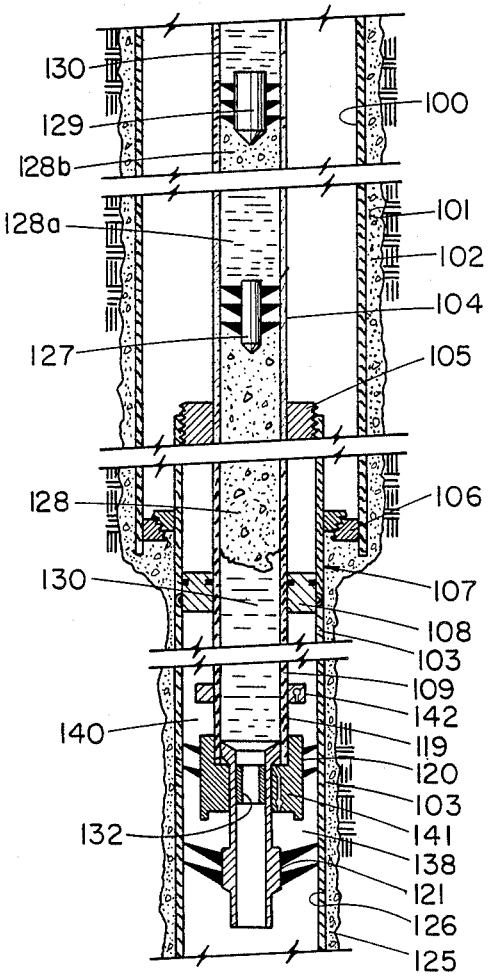
FIG. 5 is a schematic illustration of another application practicing the method of the present invention.

Referring now to FIG. 5, another application of the present invention is illustrated. In FIG. 5, from the earth's surface, a surface casing 100 is cemented in a borehole 101 by a column of cement 102. A string of pipe or tubing 104 extends between the earth's surface and the top of a tubular liner 103. The string of pipe or tubing 104 is connected to a cementing manifold and pump down plug dropping head at the earth surface (not shown) and to a liner setting tool 105 in the well bore. Apparatus, as illustrated in FIG. 5 is more completely described in U.S. Pat. No. 4,671,358.

As schematically illustrated in FIG. 5, the liner 103 includes liner hanger slips 106 and a setting adapter 107 in which a pack-off assembly 108 is sealingly and releasably locked. The string of pipe or tubing 104 is slidably and sealingly received in the pack-off assembly 108 and at the lower end of the string of pipe 104 is a tubular member 109 which releasably receives an upper tubular wiper plug 120 and a lower tubular wiper plug 121 which are independently releasably attached to the tubular member 119. The liner 103 at its lower end would include an upper plug catcher or landing collar (not shown) and a lower ball valve seat (not shown) if a hydraulic setting tool is used. At the terminal end of the liner 103 would be a casing shoe or cementing equipment (not shown).

As shown in FIG. 5, the liner hanger slips 106 are initially set just above the lower end of the casing 100. After setting the liner hanger slips 106, the string of pipe 104 with the pack-off assembly 108 is positioned in the setting adapter 107 and the pack-off assembly is releasably locked to the setting adapter 107. After circulating the mud from the surface through the string of pipe 104 and return of the mud to the earth's surface via a borehole annulus 125 between the liner 103 and the borehole 126, a first calculated volume of the cement slurry 128 is pumped into the string of pipe 104 for filling the annulus between the cementing equipment at the lower end of the liner and the stage valve (not shown) as in FIG. 2. The first cement slurry 128 is followed by a pump down plug 127 and a column of clean fluid or buffer **128*a* which is calculated to extend between the stage valve and the cementing equipment at the bottom of the pipe 103. Finally a second calculated volume of cement slurry 128B to fill the upper annulus between the stage valve and the liner to liner hanger 107 is followed by a second cementing pump down plug 129 which is released from the manifold and is located behind the cement slurry 128B to separate the cement slurry 128E from drilling mud 130. The drilling mud 130 also precedes the cement slurry 128**.

The first pump down plug 127 engages and closes off the bore of the lower cementing liner wiper plug 121 by latching to a fixed valve sleeve 132 in the cementing liner wiper plug 121. (In the '358 patent, the sleeve 32 is movable.) The lower cementing liner wiper plug 121 is then released from the end of the tubular member 119 and the assembly moves downwardly until it engages and is latched in the lower plug catcher (not shown). While the wiper plug 121 is moving downward (by virtue of applied pressure) cement slurry 128 below the pump down plug 127 passes to the cementing float shoe and into the lower annulus between the liner 103 and the borehole 126. Cement slurry is moved up the lower borehole annulus to the stage valve. When the first cement slurry reaches the stage collar, the wiper plug 121 is in the landing collar in the shoe. Hydraulic pressure then builds up and the stage valve is then opened by the sleeve moving upwardly. The cement slurry **128*b* then passes into the upper annulus above the stage collar. Subsequently, the upper pump down plug 129 engages the bore of the upper cementing liner wiper plug 120 and closes off its bore. The upper cementing liner wiper plug 120 is then released from the tubular member 109 and the assembly travels downwardly with the second pump down plug until it engages the stage valve. Upon latching of the plug 120 in the stage valve, the stage valve is closed by moving the sleeve downwardly and the stage valve retains the cement slurry in position in the upper borehole annulus until the cement sets. It is, of course, possible that the upper liner wiper plug 120 will be released by the pump down plug 129 prior to the time that the lower liner wiper plug 121** reaches the lower plug catcher (not shown) dependent upon the relative volumes of cement and well bore fluid already in place. The above system minimizes cement contamination by separating the drilling mud and mud materials on the inside of the pipe and liner by the wiper members on the pump down plug and liner wiper lugs both ahead of and behind the cement column.

The upper liner wiper plug 120 has a one-way fluid bypass 141 below its cup members for bypassing fluid under pressure in the space 138 between the plugs 120 and 121 to the interior of the tubular member 109. A collar 142 connects to the tubular member 109 above the cup members of the upper wiper plug 120 has a one way fluid bypass valve for bypassing fluid under pressure in the space 140 above the plug 120 to the interior of the tubular member 109.

In the foregoing description of a preferred embodiment in FIG. 2, a barrier 42 and recess 80 are employed, however, the same function can be obtained by offsetting the ratchet portions longitudinally so that the inner sleeve shifts between an intermediate, an upper and a lower position and the ratchet portions engage in the lower position. This structure will not, however, positively insure that the sleeve member is not movable or moved by a wiper plug.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A stage valve for use in a string of pipe for introducing cement slurry to an annulus between the string of pipe and a borehole at a location along the length of the string of pipe, said stage valve including:

a tubular stage collar adapted for coupling in a string of pipe;

a tubular sleeve valve member slidably received in said stage collar and being movable between first and second longitudinal positions relative to said stage collar;

said sleeve valve member having a piston portion located in an annular chamber between said sleeve valve member and said stage collar, said sleeve valve member having a sleeve valve port with access to one surface of said piston portion in said annular chamber for placing said one surface in fluid communication with the bore of said sleeve valve member, said stage collar having a stage collar port with access to the other surface of said piston portion in said annular chamber for placing said other surface in fluid communication with the exterior of the stage collar;

said piston portion separating said sleeve valve port from said stage collar port in said first longitudinal position and permitting said ports to be in fluid communication with one another when said sleeve valve member is in said second longitudinal position;

said sleeve valve member having a longitudinally spaced apart locking external ratchet portion and an annular recess portion;

said stage collar having a resilient internal ratchet ring located for alignment with said locking external ratchet portion in said one of said longitudinal positions;

barrier means disposed between said locking external ratchet portion and said resilient internal ratchet ring normally for preventing locking engagement of said locking external ratchet portion and said internal ratchet ring in said first longitudinal position; and said sleeve valve member in said first longitudinal position being movable in response to differential pressure across said piston portion for moving the sleeve valve member to the second longitudinal position where said valve sleeve port and said stage collar port are in fluid communication and where said annular recess portion receives said barrier means so that upon movement of upon movement of said sleeve valve member back to said first longitudinal position, said locking external ratchet portion and said internal ratchet ring are engaged and said ports are out of fluid communication with one another.

2. The stage valve as set forth in claim 1 and further including release means for releasably retaining said sleeve valve member in said first longitudinal position and being releasable upon developing a predetermined pressure differential across said piston portion.

3. The stage valve as set forth in claim 2 wherein said release means is a shear pin.

4. A stage valve for use in a string of pipe for introducing cement slurry to an annulus between a liner and a borehole at a location along the length of the string of pipe, said stage valve including:

a tubular stage collar adapted for coupling in a pipe so that said stage collar can have a relative "upper" and "lower" end where the lower end would be oriented in a string of pipe toward a bottom end of a string of pipe;

a tubular sleeve valve member slidably received in said stage collar, said sleeve valve member having a downwardly facing shoulder in engagement with an upwardly facing shoulder in said stage collar in a first lower position;

said sleeve valve member being located in said first lower position and being movable upwardly from said first lower position relative to said stage collar to a second upper position located toward the upper end of said stage collar;

said sleeve valve member having a piston portion located in an annular chamber between said sleeve valve member and stage collar, said sleeve valve member having a sleeve valve port with access to one surface of said piston portion in said annular chamber for placing said one surface in fluid communication with the bore of said sleeve valve member, said stage collar having a stage collar port with access to the other surface of said piston portion in said annular chamber for placing said other surface in fluid communication with the exterior of the stage collar;

said piston portion separating said sleeve valve port from said stage collar port in said first lower position and permitting said ports to be in fluid communication with one another in said second upper position;

said sleeve valve member having a locking external ratchet portion;

said stage collar having a resilient internal ratchet ring located for alignment with said locking external ratchet portion in a locking longitudinal position;

said sleeve valve member in said first lower position being movable in response to differential pressure across said piston portion for moving the sleeve valve member to said upper position where said valve sleeve port and said stage collar port are in fluid communication, said sleeve valve member being movable thereafter to said locking longitudinal position where said locking external ratchet portion and said internal ratchet ring are engaged and said ports are out of fluid communication with one another.

5. The stage valve as set forth in claim 4 and further including release means for releasably retaining said sleeve valve member in said first lower position and being releasable upon developing a predetermined pressure differential across said piston portion.

6. The stage valve as set forth in claim 5 wherein said release means is a shear pin.

7. The stage valve as set forth in claim 5 and further including a barrier means disposed between said locking external ratchet portion and said resilient internal ratchet ring for normally preventing locking engagement of said locking external ratchet portion and said internal ratchet ring in said first lower position, and movable from between said ratchet portion and ratchet ring for permitting engagement of said ratchet portion and said ratchet ring.

8. The stage valve as set forth in claim 7 and further including an annular recess in said sleeve valve member for receiving said barrier means.

9. A method for stage cementing a string of pipe in a well bore where the string of pipe includes a stage valve having a tubular valve collar intermediate of its length and has a tubular sleeve valve member slidably received in said stage collar for movement between first and second longitudinal positions relative to said stage collar and where said sleeve valve member has a flange in engagement with an engagement surface on said valve collar in said first longitudinal position and where said sleeve valve member has a piston portion located in an annular chamber between said sleeve valve member and said valve collar and where said sleeve valve member has a sleeve valve port with access to one surface of said piston portion in said annular chamber for placing said one surface in fluid communication with the bore of said sleeve valve member and said valve collar has a valve collar port with access to the other surface of said piston portion in said annular chamber for placing said other surface in fluid communication with the exterior of the valve collar, and said piston portion separates said sleeve valve port from said valve collar port in a said first longitudinal position and permits said ports to be in fluid communication with one another in an said second longitudinal position, the method including the steps of:

positioning the string of pipe and stage collar in a well bore;

introducing a first cement slurry to the bore of the string of pipe where the first cement slurry is followed by a wiper plug and the cement slurry is for cementing a lower annulus between the string of pipe and the well bore from the bottom of the well bore to the stage collar while the ports are separated by said piston portion;

closing off the bore of the string of pipe below the stage collar and applying hydraulic pressure to the fluid in the string of pipe to shift the flange on said sleeve valve member upwardly from said engagement surface by the hydraulic pressure in the stage collar and in the string of pipe to said second longitudinal position and to place said valve collar port in fluid communication with said sleeve valve port;

introducing a second cement slurry to the stage collar through said ports for cementing an annulus from the stage collar to the top of the string of pipe.

10. The method as set forth in claim 9 wherein the first wiper plug is inserted to follow the first cement slurry so that the wiper plug wipes the wall of the pipe, and seating the wiper plug in a landing nipple below the stage collar for closing off the bore of the pipe;

inserting a second wiper plug to follow the second cement slurry so that the second wiper plug wipes the wall of the string of pipe, and seating the second wiper plug in the sleeve valve member so that the application of pressure can move said sleeve valve member from the second longitudinal position downwardly to the first longitudinal position.

11. The method as set forth in claim 10 wherein a second wiper plug is inserted to follow the second cement slurry so that the wiper plug wipes the wall of the string of pipe and seating the second wiper plug in the sleeve valve member so that the application of pressure can close said stage valve.

12. The method as set forth in claim 9 wherein a wiper plug is inserted to follow the second cement slurry so that the wiper plug wipes the wall of the pipe, and seating the wiper plug in the sleeve valve member so that the application of pressure moves the stage valve downwardly from the second longitudinal position to the first position.

13. The method as set forth in claim 12 and further including the step of locking the sleeve valve member in the first longitudinal position after moving the sleeve valve member downwardly.

14. A stage valve for use in a string of pipe for introducing cement slurry to an annulus between the string of pipe and a borehole at a location along the length of said string of pipe, said stage valve including:

a tubular stage collar adapted for coupling in a string of pipe with an upper end for positioning toward a ground surface and a lower end for positioning toward the bottom of a borehole;

a tubular sleeve valve member slidably received in said stage collar, said sleeve valve member in a first position having a flange member with a downwardly facing surface in engagement with an upwardly facing surface on the stage collar, said sleeve valve member being movable from said first lower position to a second upper position relative to said stage collar;

means on said sleeve valve member responsive to hydraulic pressure for moving said sleeve valve member from said first lower position to said second upper position;

port means in sleeve valve member and said stage collar for defining a sleeve valve port and a stage collar port;

means cooperating with said port means for permitting said ports to be in fluid communication with one another when said sleeve valve member is in said second upper longitudinal position and for isolating said ports from one another when said sleeve valve member is in said first lower longitudinal position; and means on said sleeve valve member for positively locking said sleeve valve member to said stage collar after said sleeve valve member is moved from said second upper position to said first lower position.

15. A stage valve for use in a string of pipe for introducing cement slurry to an annulus between the string of pipe and a borehole at a location along the length of said string of pipe, said stage valve including:

a tubular stage collar adapted for coupling in a string of pipe with an upper end for positioning toward a ground surface and a lower end for positioning toward the bottom of a borehole;

a tubular sleeve valve member slidably received in said stage collar, said sleeve valve member in a first position having a flange member with a downwardly facing surface in engagement with an upwardly facing surface on the stage collar, said sleeve valve member being movable from said first lower position to a second upper position relative to said stage collar;

means on said sleeve valve member responsive to hydraulic pressure for moving said sleeve valve member from said first lower position to said second upper position;

port means in sleeve valve member and said stage collar for defining a sleeve valve port and a stage collar port;

means cooperating with said port means for permitting said ports to be in fluid communication with one another when said sleeve valve member is in said second upper longitudinal position and for isolating said ports from one another when said sleeve valve member is in said first lower longitudinal position; and means on said sleeve valve member for locking said sleeve valve member to said stage collar after said sleeve valve member is moved from said second upper position to said first lower position, said means on said sleve valve member for locking said sleeve valve member to said stage collar including a longitudinally spaced apart locking external ratchet portion and an annular recess portion;

said stage collar having a resilient internal ratchet ring located for alignment with said locking external ratchet portion in said first lower position;

a barrier member disposed between said locking external ratchet portion and said resilient internal ratchet ring normally for preventing locking engagement of said locking external ratchet portion and said internal ratchet ring in said first lower position; and said sleeve valve member in said second upper position placing said annular recess portion in a position to receive said barrier so that upon movement of said sleeve valve member back to said first lower position, said locking external ratchet portion and said internal ratchet ring are engageable and said ports are out of fluid communication with one another.

* * * * *

UNITED STATES PATENT AND TRADEMARK OFFICE

CERTIFICATE OF CORRECTION

PATENT NO. : 4,880,058

DATED : November 14, 1989

INVENTOR(S) : Hiram E. Lindsey and Richard W. Adams

It is certified that error appears in the above—identified patent and that said Letters Patent is hereby corrected as shown below:

In the Drawings:

FIG. 2 is corrected to show that the sleeve valve member 50 can be moved upwardly relative to the housing member 31.

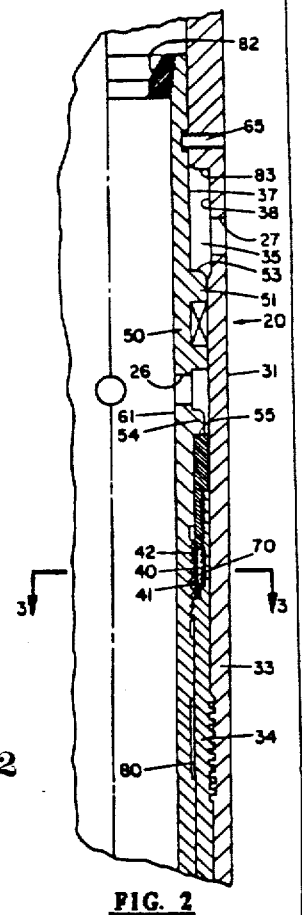

FIG. 2

Signed and Sealed this

Twenty-eighth Day of July, 1992

*Attest:*

DOUGLAS B. COMER

*Attesting Officer*

*Acting Commissioner of Patents and Trademarks*